US005289953A

United States Patent [19]

McMillan, III et al.

[11] Patent Number: 5,289,953

[45] Date of Patent: Mar. 1, 1994

[54] BEVERAGE SERVICE PITCHER

[76] Inventors: Joseph P. McMillan, III, 15 Arlington St., Asheville, N.C. 28801; Lawrence W. Owen, Jr., 1995 N. Hwy. 25, Travelers Rest, S.C. 29690

[21] Appl. No.: 48,363

[22] Filed: Apr. 15, 1993

Related U.S. Application Data

[63] Continuation-in-part of Ser. No. 914,882, Jul. 16, 1992, abandoned.

[51] Int. Cl.[5] ..... A47G 19/14

[52] U.S. Cl. ..... 222/189; 222/465.1; 222/478; 222/572; D7/315; D7/318

[58] Field of Search ..... 222/465.1, 475.1, 478, 222/566, 572, 189; D7/312, 315, 316, 318, 319

[56] References Cited

U.S. PATENT DOCUMENTS

| | | | |
|---|---|---|---|
| D. 160,080 | 9/1950 | Fleming | D7/315 |
| D. 187,940 | 5/1960 | Hughes | D7/315 |
| D. 221,168 | 7/1971 | Benes | D7/318 |
| D. 319,755 | 9/1991 | Guy | D7/315 X |
| 28,771 | 6/1860 | Petton | 222/189 |
| 691,052 | 1/1902 | Freeman | 222/189 |
| 790,052 | 5/1905 | Hardie et al. | 222/189 |
| 816,858 | 4/1906 | Ham | 222/189 |
| 866,545 | 9/1907 | Whitman | 222/189 |
| 1,104,490 | 7/1914 | Glazier | 222/572 |
| 2,069,089 | 1/1937 | Goldman et al. | 222/478 X |
| 2,649,967 | 8/1953 | Tyson | 222/189 X |
| 4,957,224 | 9/1990 | Kessler et al. | 222/465.1 |

*Primary Examiner*—Andres Kashnikow
*Assistant Examiner*—Anthoula Pomrening
*Attorney, Agent, or Firm*—Kennedy & Kennedy

[57] ABSTRACT

A pitcher (10) for the controlled delivery of a liquid or a combination of liquids and solids together into another container. The pitcher has a front chute (18) for the pouring of liquids contained near the base of the pitcher and two side chutes (20, 21) for the pouring of a combination of liquids and solids.

12 Claims, 6 Drawing Sheets

BEVERAGE SERVICE PITCHER

This application is a continuation-in-part of U.S. Pat. Application Ser. No. 914,882, filed on Jul. 16, 1992, now abandoned.

TECHNICAL FIELD

The present invention is a beverage service container or pitcher adapted for use in serving liquids and mixtures of liquids and solids with specific gravities less than the liquids such as ice cubes and fruit.

BACKGROUND OF THE INVENTION

Assorted liquids and solids have been stored, transported and served from pitchers of various construction for literally thousands of years. Three main concerns have remained in their designs namely 1) the volume of the pitcher, 2) protection given by the pitcher to the product being retained for transfer, and 3) the means of delivery of the liquid contained within the pitcher. Over the centuries the size and shape of pitchers have changed in an attempt to meet these three concerns.

Today, pitchers are commonly used to dispense beverages with ice such as ice water and ice tea. However, a difficult challenge has been finding a means by which to control the transfer of the liquid from the pitcher to another container such as a glass while guarding against spillage and preventing unwanted dispensement of the solids which for brevity are hereinafter referred only to as ice cubes.

When liquids and ice cubes are combined, their transfer from a pitcher to another container becomes more difficult. For instance, service pitchers now prevalent in the art cause splashing of the liquid during the process of pouring, especially when the contents are a liquid combined with ice cubes, due to inefficient spout and spill guard design. In order to control and direct the pour with a conventional pitcher, the fluid exit point or spout is made narrow. The size of the spout is usually smaller than that of the ice cubes afloat in the liquid. When pouring from these pitchers the dispensed liquid originates from near the top surface of the pitcher which causes the floating ice cubes to be entrained into the dispensing stream of liquid. The ice cubes often block the spout causing the slowing or completely blocking off of the flow of liquid which results in spillage. This blockage takes place all to frequently in currently used service pitchers.

U.S. Pat. No. 4,957,224 addresses this problem by teaching the combination of pouring lobes and spill guards as a means of controlling the flow of liquid and ice cubes. A principal feature of this pitcher is its spill guard which extends from the upper rim of the pitcher toward its center. This pitcher however still has the disadvantage of the ice cubes blocking the spout, thus causing spillage.

The need for controlled and non-disruptive transfer of liquid-solid combinations remains today a major concern of the hospitality industry, institutions, commercial kitchens, restaurants, and of the domestic sector. Inefficient spout and spill guard designs still do not prevent spillage in the majority, if not all, of service pitchers available in today's market.

Accordingly, it is seen that a need remains for a pitcher from which a combination of liquids and ice cubes may be poured in a more effective and controlled manner. Accordingly, it is to the provision of such that the present invention is primarily directed.

SUMMARY OF THE INVENTION

In a preferred form of the invention, a pitcher for holding a liquid having ice cubes immersed therein comprises a bottom wall, a sidewall extending from the bottom wall and having a lip located distally from the bottom wall, a handle outwardly extending from a handle portion of the sidewall. The pitcher also has a first elongated chute extending outwardly from a first chute portion of the sidewall which is located opposite to and forward of the handle portion of the sidewall, a second elongated chute extending outwardly from a second chute portion of the sidewall which is located between and sideways of the handle portion and the first chute portion. The second chute has a size and shape for aligning and accommodating a succession of ice cubes as the pitcher is tilted for dispensing liquid and ice cubes together from the second chute. The first and second chutes each extend from adjacent the bottom wall to adjacent the sidewall lip. The pitcher also has strainer means for preventing ice cubes of a selected minimum size in the pitcher from entering one of the chutes. With this construction a stream of liquid without ice cubes may be poured from one of the chutes tilting the pitcher held by the handle in one direction and a stream of liquid with ice cubes may be poured from another of the chutes by tilting the pitcher in another direction.

DETAILED DESCRIPTION OF THE INVENTION

Figure 1:
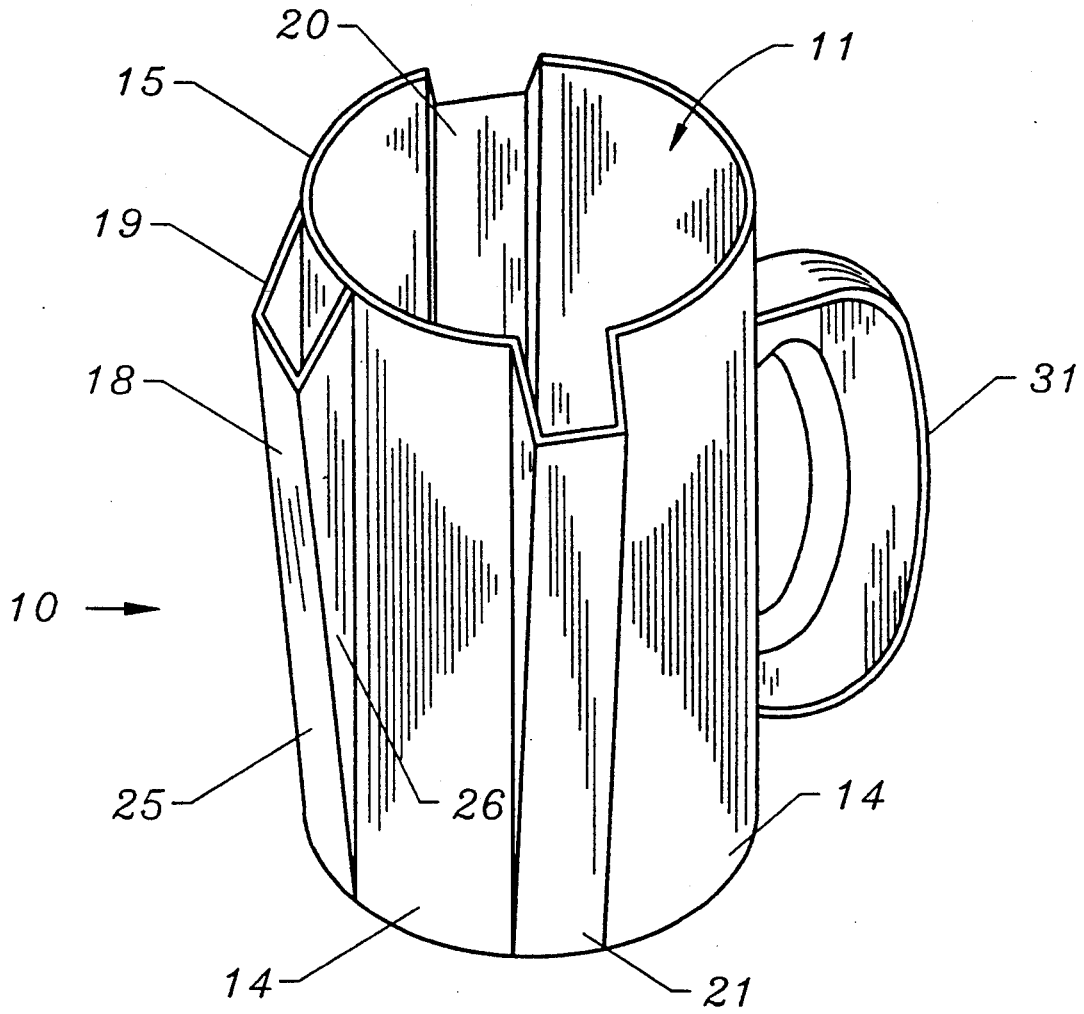
FIG. 1 is a perspective view of a pitcher that embodies principles of the invention in a preferred form.
Figure 3:
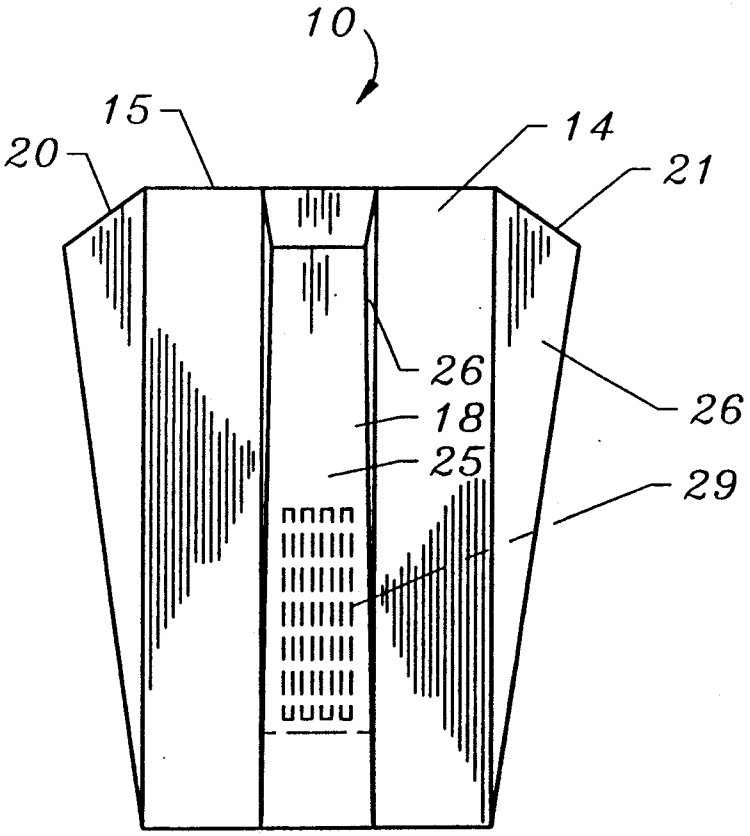
FIG. 3 is another side view of the pitcher of FIG. 1.
Figure 2:
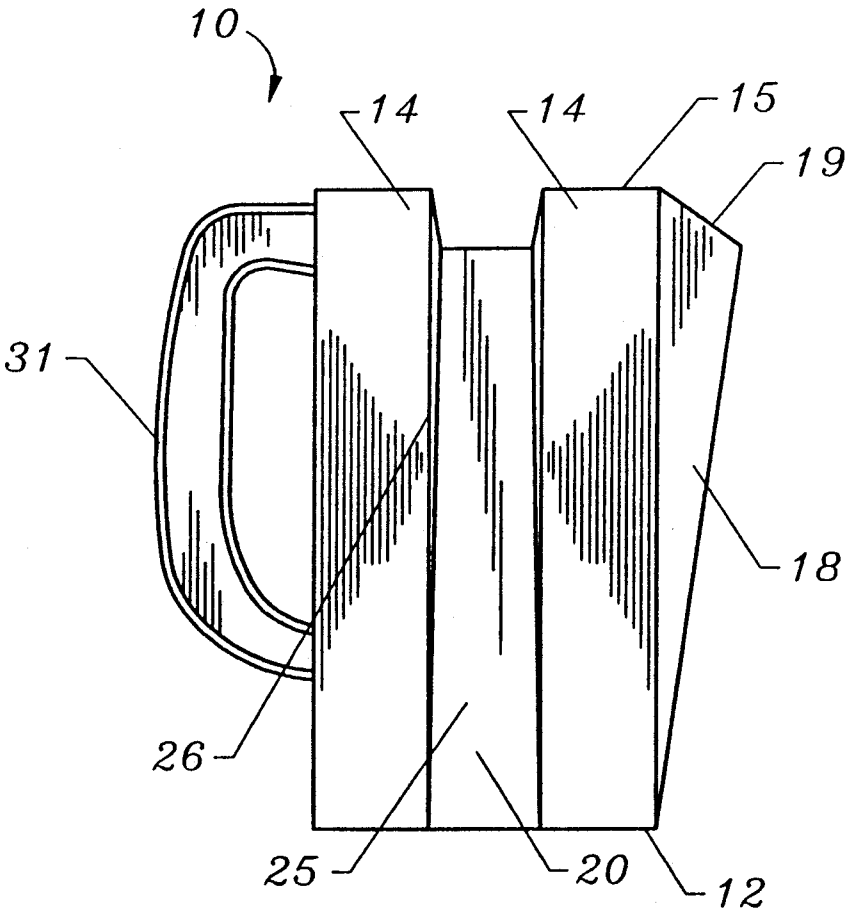
FIG. 2 is a side view of the pitcher of FIG. 1.
Figure 5:
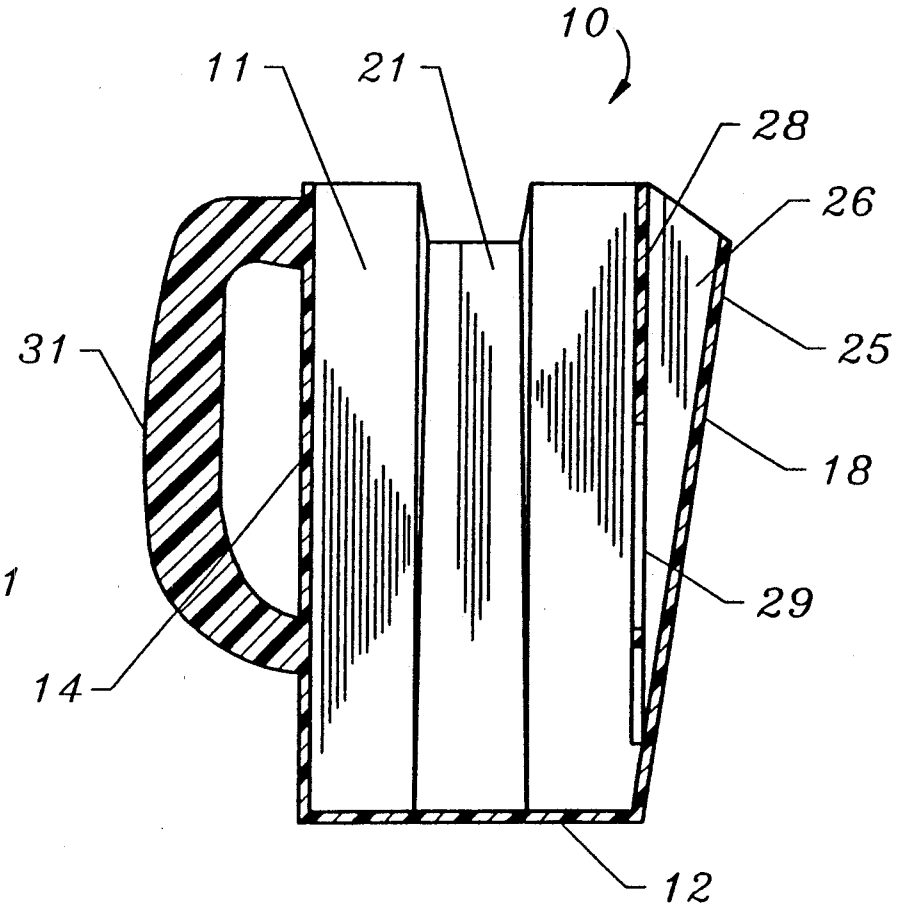
FIG. 5 is a cross-sectional view of the pitcher of FIG. 1.
Figure 4:
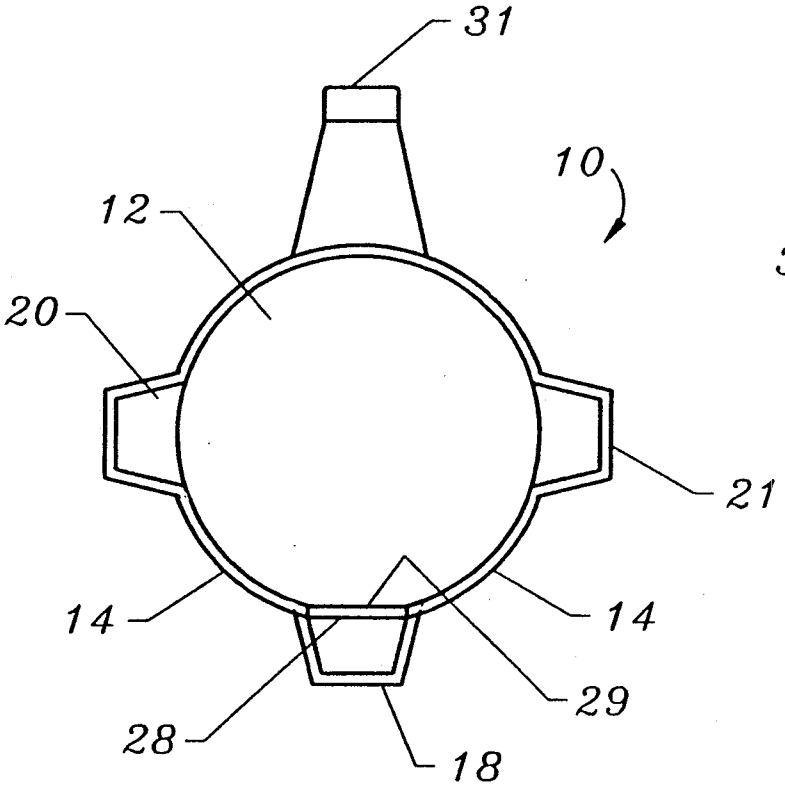
FIG. 4 is top view of the pitcher of FIG. 1.
Figure 7:
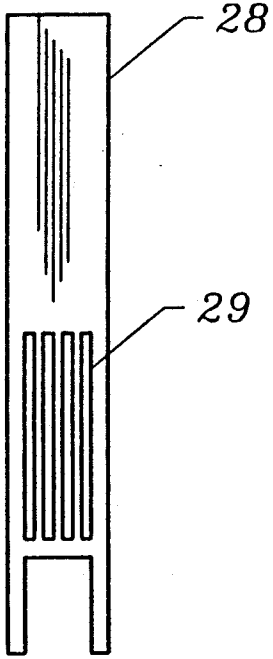
FIG. 7 is a front view of the strainer of the pitcher of FIG. 1.
Figure 6:
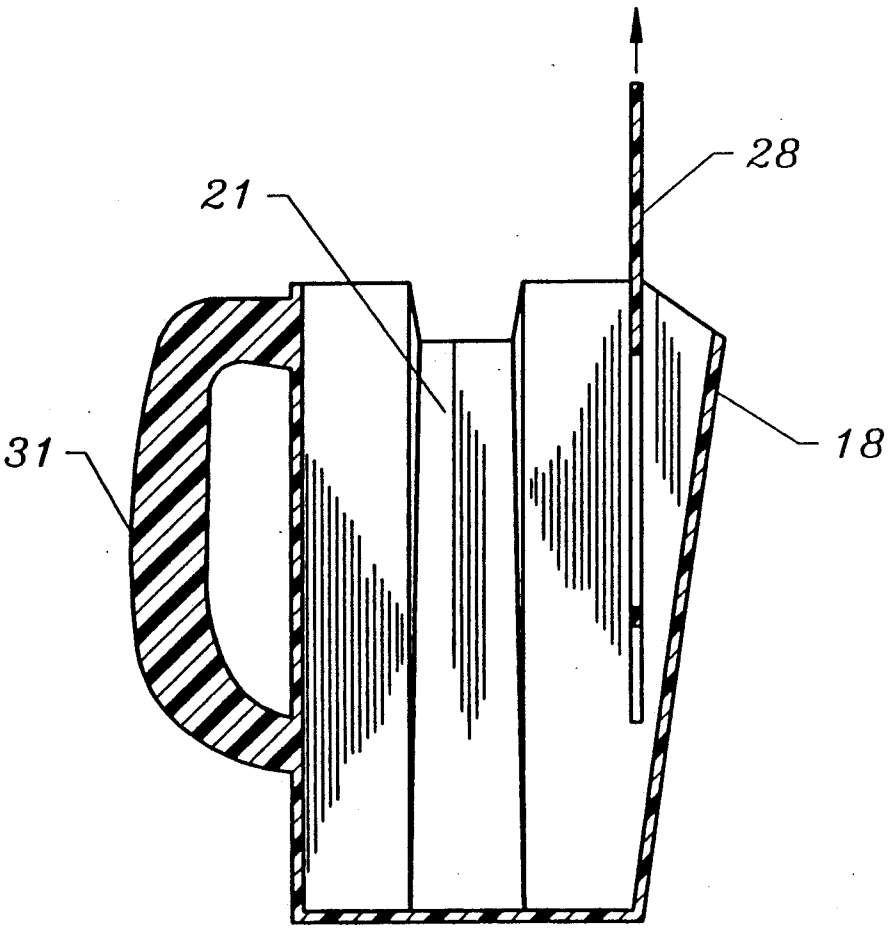
FIG. 6 is a cross-sectional view of the pitcher of FIG. 1 shown with a strainer partially removed.

Referring to FIG. 1, an open top pitcher 10 is shown having a chamber 11 defined by a bottom wall 12, sidewalls 14 which extend from the bottom wall 12 and which have a top edge or lip 15, a front chute or flow channel 18 having a top edge 19, and two laterally opposed side chutes or flow channels 20 and 21 each having a top edge 22. Each chutes 18, 20 and 21 has a tapered floors 25 and two edge walls 26. The pitcher 10 also has a strainer 28 with apertures 29 therethrough and a handle 31 mounted to the exterior of the sidewall 14 opposite the front chute 18.

The strainer 28 is removably mounted to the front chute 18 so as to allow the passage of liquid into the front chute while excluding solid matter. The apertures 29 are preferably located at least one inch below the top edge 19 of the front chute to permit the flow of liquids from below the top surface of the contained liquid. Alternatively, the strainer may also be formed as part of the sidewalls 14 and therefore fixed in place. Various sizes or designs of apertures may be included for adapting the invention for the delivery of different combinations of liquids and solids.

The side chutes 20 and 21 are each positioned generally ninety degrees to the front chute 18 so that the server has the option of either right handed or left handed service. As desired, each of the side chutes 20 and 21 can be the same or different in configuration. In the preferred embodiment, the configurations of the side chutes are substantially the same. The side chutes are of a size and shape to align the ice cubes in a generally linear manner therein.

The pitcher can be constructed by molding without the handle 31, if desired, where the overall dimensions of the pitcher are relatively small. However, for commercial and institutional service, a pitcher of about 2.5 quarts capacity is generally preferred. Thus, a relatively sturdy handle is usually required for support.

The pitcher may be constructed by generally known manufacturing operations, such as blow molding, injection molding, casting, extrusion, drawing and the like. Blow molding is particularly preferred when using plastic materials.

Materials for constructing a pitcher of this invention are non-toxic, rigid and easily sanitized, to comply with the Food Additives Amendment Act of 1958 to the Federal Food, Drug and Cosmetic Act. Examples of materials that meet these criteria include glass, synthetic resin plastic, aluminum, stainless steel and the like. Preferred construction may be moldable plastic materials suitable for blow molding operations. Exemplary materials are polymeric plastics, such as polypropylene, polyethylene, polyvinyl chloride, polyethylene terephthalate, polycarbonates, acrylic plastics, and the like. Polycarbonates are particularly preferred for blow molding a pitcher of this invention.

Figure 8:
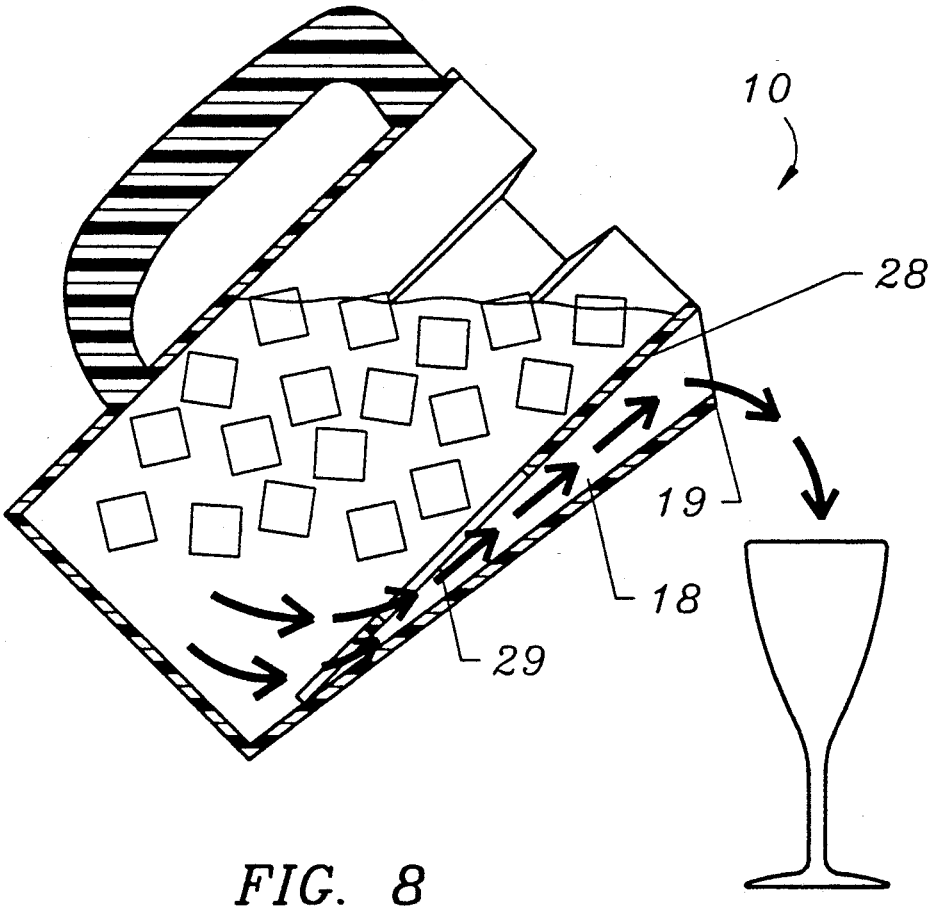
FIG. 8 is a cross-sectional view of the pitcher of FIG. 1 showing the dispensement of liquids.
Figure 9:
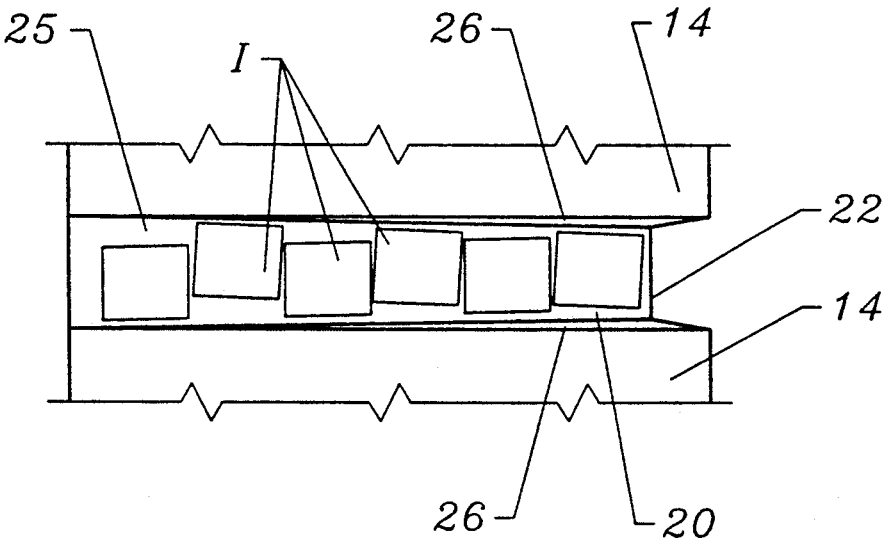
FIG. 9 is a view of a portion of the side chute of the pitcher of FIG. 1 showing the linear alignment of ice cubes.

In use, with the pitcher 10 filled with a combination of a liquid and ice cubes, the ice cubes gather along to the top portion of the liquid, as shown in FIG. 8. The pitcher may be utilized for dispensing only the liquid by tilting the pitcher so as to cause the liquid to pass through the strainer 28, into the front chute 18 and over the top edge 19 of the front chute, as illustrated with arrows. Since the strainer apertures 29 extend through the bottom portion of the strainer, the liquid which passes through the strainer is not accompanied by the ice cubes. This also allows the portion of the liquid which is the most undiluted by the melting of the ice cubes, i.e. the lower portion of the liquid contained within the pitcher, to be dispenses through this chute. Thus, a server may dispense the highest concentration of the liquid with the front chute into a container that already has ice cubes.

The server may also choose to dispense a combination of both liquid and ice cubes by tilting the pitcher to either side so that both liquid and ice cubes flow through a side chute 20 or 21 and over the top edge 22 of the chute. Since the ice cubes align themselves linearly within the side chutes, they tend to flow at approximately the same rate of the liquid, thus minimizing splashing and spilling during dispensement. The elongation of the chute and its substantially flat floor also aids the flow of the ice cubes by allowing the flow to increase in speed as it travels through the chute and by providing a smooth, flat surface for facilitating a more laminar flow of the ice cubes. The tapering of the chutes 18, 20 and 21 increases the speed of the flow as the liquid flows through the chute.

From the foregoing it is seen that a pitcher is now provided which overcomes problems long associated with those of the prior art. It should be understood however that the just described embodiment merely illustrates principles of the invention in its preferred form. Many modifications, additions and deletions may, of course, may be made thereto without departure from the spirit and scope of the invention as set forth in the following claims.

We claim:

1. A pitcher for holding a liquid having ice cubes immersed therein comprising, a bottom wall, a sidewall extending from said bottom wall and having a lip located distally from said bottom wall, a handle outwardly extending from a handle portion of said sidewall, a first elongated chute extending outwardly from a first chute portion of said sidewall located opposite to and forward of said handle portion of said sidewall, a second elongated chute extending outwardly from a second chute portion of said sidewall located between and sideways of said handle portion and said first chute portion, said second chute having a size and shape for aligning and accommodating a succession of ice cubes as the pitcher is tilted for dispensing liquid and ice cubes together from said second chute, said first and second chutes each extending from adjacent said bottom wall to adjacent said sidewall lip, and strainer means for preventing ice cubes of a selected minimum size in the pitcher from entering one of said chutes, whereby a stream of liquid without ice cubes may be poured from one of the chutes tilting the pitcher held by the handle in one direction and a stream of liquid with ice cubes may be poured from another of the chutes by tilting the pitcher in another direction.

2. The pitcher of claim 1 wherein said strainer means is mounted adjacent said first chute so that the stream of liquid without ice cubes is poured from said first chute by tilting the pitcher forwardly and the stream of liquid with ice cubes may be poured from said second chute by tilting the pitcher sideways.

3. The pitcher of claim 1 further comprising a third elongated chute extending outwardly from a third chute portion of said sidewall located between and sideways of said handle portion and said first chute portion, said third chute extending from adjacent said bottom wall to adjacent said sidewall lip and having a size and shape for aligning and accommodating a succession of ice cubes as the pitcher is tilted for dispensing liquid and ice cubes together from said third chute.

4. The pitcher of claim 1 wherein said strainer means is removably mounted to said first chute.

5. The pitcher of claim 1 wherein said strainer means has apertures located proximal said bottom wall for allowing liquid generally proximal said bottom wall to enter said first chute.

6. The pitcher of claim 1 wherein said first chute has a substantially flat, elongated floor.

7. The pitcher of claim 6 wherein said first chute floor tapers as it extends away from said bottom wall.

8. A pitcher for holding a liquid having ice cubes immersed therein comprising, a bottom wall, a side wall extending from said bottom wall and having a lip located distally from said bottom wall, a handle mounted to a handle portion of said sidewall, said sidewall having a first elongated flow channel located opposite to and forward of said handle portion, a second elongated flow channel located between and sideways of said first flow channel and said handle portion, said first and second flow channel each extending from adjacent said bottom wall to adjacent said sidewall lip and said second flow channel having a size and shape for aligning and accommodating a succession of ice cubes as the pitcher is tilted for dispensing liquid and ice cubes together from said second flow channel, and strainer means mounted for preventing ice cubes of a selected minimum size in the pitcher from entering said first flow channel, whereby a stream of liquid without ice cubes may be poured from the first flow channel by tilting the pitcher held by the handle forwardly and a stream of liquid with ice cubes may be poured from the second flow channel by tilting the pitcher sideways.

9. The pitcher of claim 8 further comprising a third elongated flow channel located between and sideways of said first flow channel and said handle portion opposite said second flow channel, said third flow channel extending from adjacent said bottom wall to adjacent said sidewall lip and having a size and shape for substantially linearly aligning and accommodating a succession of ice cubes as the pitcher is tilted for dispensing liquid and ice cubes together from said third flow channel.

10. The pitcher of claim 8 wherein said strainer means is removably mounted to said first flow channel.

11. The pitcher of claim 8 wherein said first flow channel has a substantially flat, elongated floor.

12. The pitcher of claim 11 wherein said first flow channel floor tapers as it extends away from said bottom wall.

* * * * *